US006877494B2

(12) United States Patent
White et al.

(10) Patent No.: US 6,877,494 B2
(45) Date of Patent: Apr. 12, 2005

(54) LIGHTWEIGHT FOUR-STROKE ENGINE

(75) Inventors: William Llewis White, Christchurch (NZ); Stuart Gilbert Pearson, Christchurch (NZ)

(73) Assignee: Pearson Motor Company Limited, Christchurch (NZ)

( * ) Notice: Subject to any disclaimer, the term of this patent is extended or adjusted under 35 U.S.C. 154(b) by 0 days.

(21) Appl. No.: 10/618,460

(22) Filed: Jul. 11, 2003

(65) Prior Publication Data

US 2004/0079299 A1 Apr. 29, 2004

Related U.S. Application Data

(60) Provisional application No. 60/395,707, filed on Jul. 12, 2002.

(51) Int. Cl.[7] ..... F02B 25/06
(52) U.S. Cl. ..... 123/572
(58) Field of Search ..... 123/572, 573, 123/574

(56) References Cited

U.S. PATENT DOCUMENTS 1,420,266 A 6/1922 Knox
4,068,635 A * 1/1978 Yunick ..... 123/119 B
4,185,597 A 1/1980 Cinquegrani
4,712,532 A * 12/1987 Ura et al. ..... 123/572
4,768,493 A * 9/1988 Ohtaka et al. ..... 123/573
4,962,745 A * 10/1990 Ohno et al. ..... 123/572
5,285,754 A * 2/1994 Bell ..... 123/573
5,329,913 A * 7/1994 Suzuki et al. ..... 123/573
6,338,328 B1 1/2002 Mower et al.
6,405,721 B1 * 6/2002 Moren ..... 123/572
6,412,479 B1 * 7/2002 Canfield et al. ..... 123/573

FOREIGN PATENT DOCUMENTS

GB 2130641 A 6/1984

* cited by examiner

*Primary Examiner*—Thomas Moulis
(74) *Attorney, Agent, or Firm*—Thorpe North & Western LLP

(57) ABSTRACT

A lightweight, four stroke engine includes a crankcase enclosure and at least one piston assembly disposed within the crankcase enclosure. The piston assembly cooperates with the crankcase enclosure to provide an internal pressure to the crankcase enclosure which varies between a positive and a negative pressure. An air intake assembly is operatively coupled to a first section of the engine and the crankcase enclosure, the air intake assembly including at least one air conduit configured to provide non-combustive air flow from the first section of the engine to the crankcase enclosure of the engine. At least one valve is disposed within the air intake system, the valve being configured to restrict air flow from the crankcase enclosure when positively pressurized and to allow airflow into the crankcase enclosure when negatively pressurized.

4 Claims, 14 Drawing Sheets

LIGHTWEIGHT FOUR-STROKE ENGINE

This application claims priority of U.S. Provisional Application No. 60/395,707, filed Jul. 12, 2002, which is incorporated by reference herein.

BACKGROUND OF THE INVENTION

1. Field of the Invention

The present invention relates to internal combustion engines. More particularly, the invention relates to an improved, lightweight four-stroke internal combustion engine having a favorable power to weight ratio and improved adaptability to varying applications.

2. Related Art

It is often desirable in many applications to provide an engine which is reliable, powerful, lightweight, and easily adaptable to different applications. Four-stroke engines are often considered more reliable than two-stroke engines, but often include a lower power density; that is, the unit weight to power output ratio is often higher than for two-stroke engines. Particular applications can benefit from reliable, lightweight four-stroke engines, such as in cases where operator and public safety are of heightened concern. Such applications can include motorized crafts utilized in aviation, military, and recreational applications.

The need for safety appears to be a conflicting goal with providing more power for a given engine weight, as two-stroke engines generally provide more power for the same engine weight. For example, in aircraft, recreational vehicles, portable power equipment, and the like, two-stroke engines are often used due to the desire for limited weight, but reliability of two-stroke engine has been recognized as a problem.

Further, it is desirable in many cases to adapt an engine design to a new application. However, this may involve reversing the intake and exhaust sides to flip the engine front to back or to accommodate the engine in a particular vehicle or apparatus. It may further involve reversing engine rotation direction; that is, reverse rotation direction from a counterclockwise to a clockwise direction, or the inverse. While many engines can be easily rotated about a horizontal axis, a vertically rotated mounting may be desired instead. Such changes typically involve considerable customization and engineering modification which cannot be done by a customer, but rather requires the manufacturer's specialized knowledge and expertise.

SUMMARY OF THE INVENTION

It has been recognized that it would be desirable to provide a reliable, lightweight four-stroke engine having improved power density for certain applications where both engine weight and reliability are important. It has been further recognized that it would be desirable to provide improved flexibility in application by enabling the engine to be mounted horizontally or vertically and providing an engine that can be customized to particular applications by customers or other persons without specialized mechanical and/or engineering training.

The invention provides a lightweight, four stroke engine, including a crankcase enclosure and at least one piston assembly disposed within the crankcase enclosure. The piston assembly can cooperate with the crankcase enclosure to provide an internal pressure to the crankcase enclosure which varies between a positive and a negative pressure. An air intake assembly can be operatively coupled to a first section of the engine and the crankcase enclosure, the air intake assembly including at least one air conduit configured to provide non-combustive air flow from the first section of the engine to the crankcase enclosure of the engine. At least one valve can be disposed within the air intake system, the valve being configured to restrict air flow from the crankcase enclosure when positively pressurized and to allow airflow into the crankcase enclosure when negatively pressurized.

In accordance with a more detailed aspect of the present invention a lightweight, four stroke engine, is provided and includes an engine housing comprised only of three major housing components, the housing components including: a lower crankcase housing, an upper crankcase housing, and a cylinder terminal housing; and a piston assembly operatively disposed within the engine housing. The engine housing can be configured to provide an operating enclosure for the piston assembly while minimizing an overall weight of the engine.

In accordance with a more detailed aspect of the present invention a lightweight, four stroke engine, is provided and includes an engine body having an air intake system terminating on an intake side of the engine and an exhaust system terminating on an exhaust side of the engine. An external air cooling circulation system can be configured to circulate air around the engine body from the intake side of the engine to the exhaust side of the engine to provide air cooling to the engine.

In accordance with a more detailed aspect of the present invention a lightweight, four stroke engine, is provided and includes an engine body and a disk rotor, operatively coupled to a crankshaft of the engine, the disk rotor having at least one vane associated therewith. At least one stator can be disposed adjacent the disk rotor. The stator and disk rotor can be configured to cooperatively produce electrical power in response to rotation of the crankshaft while the disk rotor vane produces airflow for cooling the engine.

DETAILED DESCRIPTION

Figure 1:
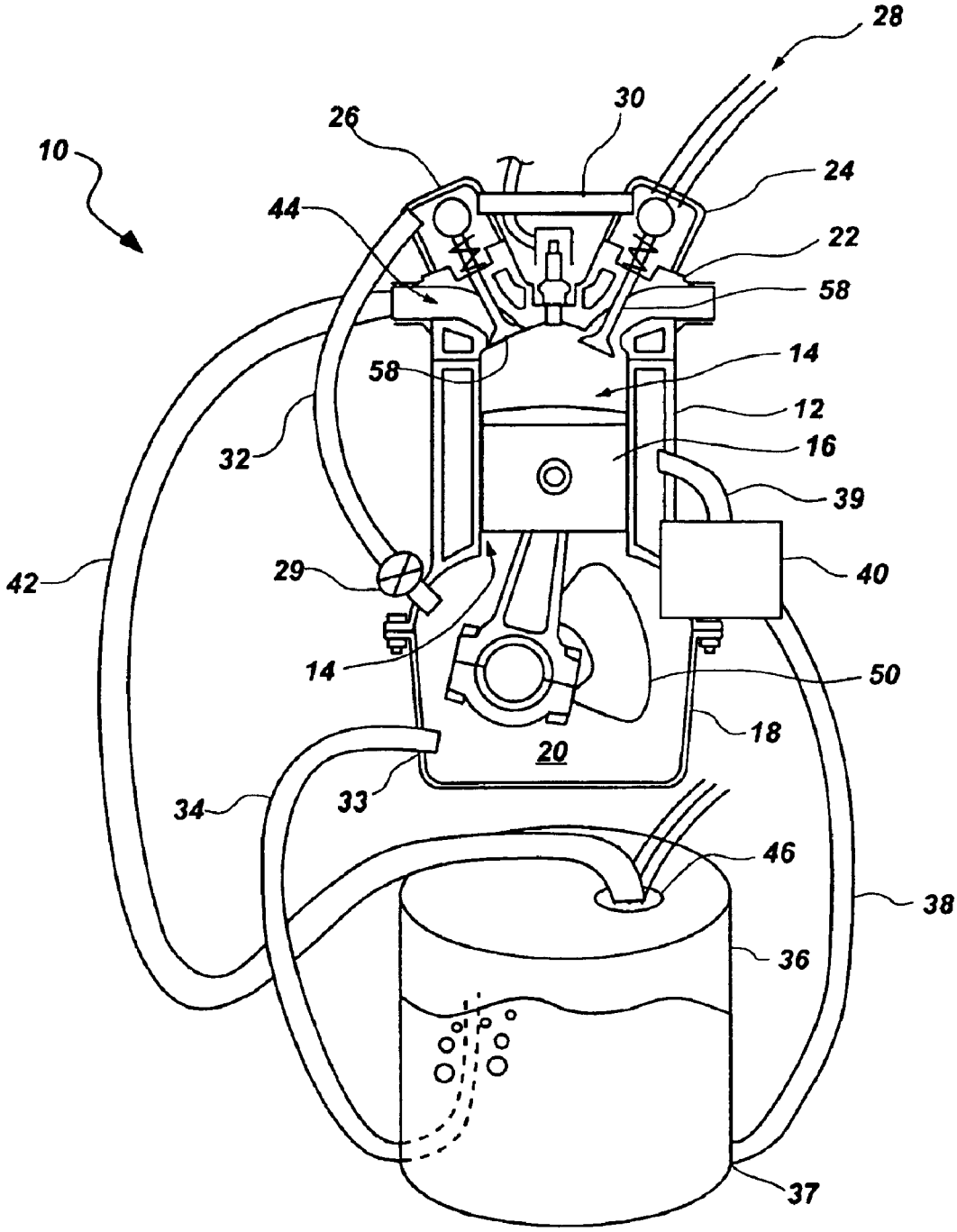
FIG. 1 is a schematic diagram of various components of a lightweight engine in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

With reference the figures, which are given by way of example and not by way of limitation, and specifically first to FIG. 2 through FIG. 5, to illustrate the environment of the invention, a four-stroke engine is provided in accordance with the invention. The engine can be air-cooled by both an internal and an external air cooling system. The engine delivers superior power to weight ratio over conventional designs. It includes a dry sump oil circulation system wherein the oil is scavenged by the internal cooling air driven by reciprocating pistons. The pistons can reciprocate together (e.g. 360 degree firing angle) and the engine alternately creates a negative and positive pressure inside a crankcase. This cyclic pressure is used with the cooperating action of one-way valves, such as reed valves, to move air through the engine. This air movement is used to scavenge oil, internally cool the engine, and can be used to supercharge the air intake to the engine. In one embodiment of the invention, the engine weighs less than 80 pounds and can deliver in excess of 60 HP.

The engine provided by the present invention can be utilized in a wide array of applications. A variety of aircraft, land vehicles, recreational vehicles, etc., can benefit from the superior performance provided by the lightweight engine. Examples of devices that can benefit from such an engine include aircraft, snowmobiles, motorcycles, all-terrain vehicles, watercraft, automobiles, etc.

Shown in schematic representation in FIG. 1 are various features of the engine. The engine 10 can include an engine block housing or portion 12 which can include a cylinder or bore 14 in which a piston 16 can be disposed. A crankcase housing or portion 18 can be coupled to engine block portion 12. The lower portion of the engine block and the crankcase housing can form a crankcase enclosure 20. As will be explained in more detail below, the crankcase housing can be formed so as to be capable of varying between an internal negative and positive pressure, relative to an ambient environment in which the engine is operated.

A cylinder head 22 can be disposed upon or formed as part of the engine block 12, and can be disposed generally above the engine block. The cylinder head can include cam boxes 24 and 26, which can house various valves and valve camshafts. The engine is a four-stroke engine with the piston 16 traveling through the bore 14 a total of four times for each combustion cycle. Typically, a four-stroke engine travels through four conventional strokes. They are known as the intake stroke, in which a combustible mixture is introduced into the bore or cylinder as the piston travels downward from a top of the cylinder; a compression stroke, wherein the combustible material is compressed; a power stroke, wherein the piston is driven downward by combustion of the combustible material; and an exhaust stroke, wherein the piston travels upward to expel combustion exhaust products. While the terms upward and downward are used herein to illustrate relative locations of the piston, the engine described herein is advantageously capable of utilizing a piston that be oriented vertically, horizontally, or at any variation between.

An air inlet 28 can be formed within cam cover or box 24 to facilitate introduction of ambient air into the cam cover. The air inlet can be a one-way inlet valve, such as is commonly known as a reed valve, in order to allow air to enter the cam box but not exit the cam box. A cam box linking conduit 30 can connect the cam boxes 24 and 26 to provide a conduit for fluid communication between the two. Thus, the air that is allowed to enter the engine through air inlet 28 can also pass through cam box 26. The air that is allowed to inlet can be used for a variety of purposes, including providing an internal coolant for the engine, scavenging oil from the engine, and supercharging the air supplied to the combustion process, as discussed in more detail below. It is to be understood that, as discussed herein, the cam box linking conduit and other conduits referenced are not limited to tubular structures but can include any fluid communication means known and can be formed internally in the various components or can be external conduits, tubes, hoses, etc.

A first feed conduit 32 can provide fluid communication between the cam box 26 and the enclosed crankcase 18. A one-way valve 29 can be fitted to the first feed conduit near or at the junction with the crankcase housing 18. As the piston 16 travels upward in either the compression or exhaust stroke, the fluid in the crankcase enclosure 20 is subject to a negative pressure. This negative pressure condition can cause air to be drawn through the air inlet 28, through cam box linking conduit 30, through the first feed conduit 32 and into the crankcase enclosure. The crankcase housing 18 can include an outlet 33 to which a second feed conduit 34 can be coupled to provide fluid communication between the crankcase enclosure 20 and an oil reservoir 36. The second feed conduit 34 can similarly include a non-return valve on an end terminating in the oil reservoir to prevent oil and/or air from moving back into the crankcase through feed conduit 34. Downward motion of the piston, in either the power or exhaust stroke, can pressurize the crankcase housing and force air and oil through second feed conduit 34 into the oil reservoir.

The oil reservoir 36 can optionally include an oil return outlet 37, which can be coupled via a third feed conduit 38 to oil pump 40. The oil pump can pump oil from the oil reservoir to an engine lubrication system (shown generally at 39), which can provide lubricant to the requisite areas of the engine. The oil return outlet 37 can similarly include a flow restriction valve which restricts oil from flowing back into the oil reservoir. While oil pump 40 can be provided, the air circulating internal cooling and oil scavenging system does not require the presence of an oil pump to cool, scavenge and supercharge air, as the air is circulated by varying pressure in the crankcase housing. In some embodiments, as discussed further below, an oil pump is provided only to provide oil or lubricant to the cam boxes 24, 26, and the oil scavenging system assists in distributing oil downwardly and throughout the engine.

It will thus be appreciated that the present invention provides an efficient air circulation system driven by variable pressure conditions created by cyclic motion of the piston. As the piston moves upwardly and downwardly in its normal mode of operation, the system of one-way valves, conduits, and pressurizable crankshaft enclosure create a positive internal airflow. The internal airflow can be advantageously used to scavenge oil from the engine while simultaneously providing internal cooling to the engine. The engine can utilize what is known as a dry-sump lubrication system, in which a minimum amount of oil is circulated throughout the engine body with a larger volume of oil stored in an external sump, or reservoir. By minimizing the amount of oil stored in the engine, excess oil does not collect on or interfere with moving parts but sufficient oil is provided to adequately lubricate the moving parts. As the air circulation is driven by pressure differentials created by normal movement of the piston, a sump pump, which is required in conventional dry sump systems, is not required, thereby reducing considerable weight from the engine and conserving power otherwise needed to drive the sump pump.

In another aspect of the invention, a fourth feed conduit 42 can feed air from the oil reservoir 36 to inlet an manifold 44, which supplies air to be combined with fuel and combusted in the bore 14. The engine thus provides an air circulation system whereby air enters the engine at air inlet 28 and flows into the crankcase through first feed conduit 32. The crankcase is pressurized by action of the piston 16 and oil and air can flow out of the crankcase through feed conduit 34 to the oil reservoir 36. As the oil reservoir is pressurized through second feed conduit 34, pressurized air is delivered through fourth feed conduit 42 to the inlet manifold where the pressurized air is used to supercharge the air delivery to the combustion cylinder.

In the case where supercharging of air delivered to the combustion cylinder is not desired, a valve 46 can be disposed in the oil reservoir 36 to allow air to flow out of the oil reservoir, as dictated by internal pressure of the reservoir. In this manner, the oil reservoir can separate the oil and air mixture delivered by conduit 34 from crankcase enclosure 20, and the oil can be stored in the reservoir and air exhausted to the environment. Alternately, the air from the reservoir can be provide to an air intake system that utilizes the air for combustion without supercharging the air with the air scavenging system.

In general, operation of the system can be understood as beginning when the piston 16 is at its most downward position, after either the intake or power stroke. As the piston moved downward, the fluid in the crankcase enclosure 20 became compressed, which results in air and/or oil being driven through the second feed conduit 34 into reservoir 36. Due to the positive pressure in the crankcase, the one-way valve 28 prevents air or oil from entering the first feed conduit 32. As oil and air are forced through the second feed conduit 34, the fluid contained in the oil reservoir 36 is pressurized, and this pressure can further serve to pressurize the air leaving the oil reservoir through fourth feed conduit 42 (in the case where supercharging of combustion air is provided). The engine can thus provide a source of pressurized air to the inlet manifold 44, and also serves to internally cool the engine and scavenge the oil in the crankcase.

When the piston 16 is at its uppermost position, after either the compression or exhaust strokes, the upward motion of the piston subjects the fluid in the crankcase enclosure 20 to a negative pressure. This in turn allows the air inlet 28 to open and allow air to enter the cam box 24, and consequently, cam box 26, first feed conduit 32, and re-supplies the crankcase with a fresh air supply. Because of the one-way valve located at the outlet 33, air and oil are prevented from being drawn up through the second feed conduit 34 from reservoir 36.

Once the piston finishes its upward travel, the cycle is then reversed, and the air inlet 28 closes, the reed valve at outlet 33 opens, and the fluid in the oil reservoir is again pressurized, which in turn allows the delivery of pressurized air to the inlet manifold 44 through fourth feed conduit 42. The system can thus provide a substantially constant flow of air through the engine, which serves the multiple purposes of cooling the engine, scavenging the engine oil, and supercharging the air provided to the combustion process.

Figure 2:
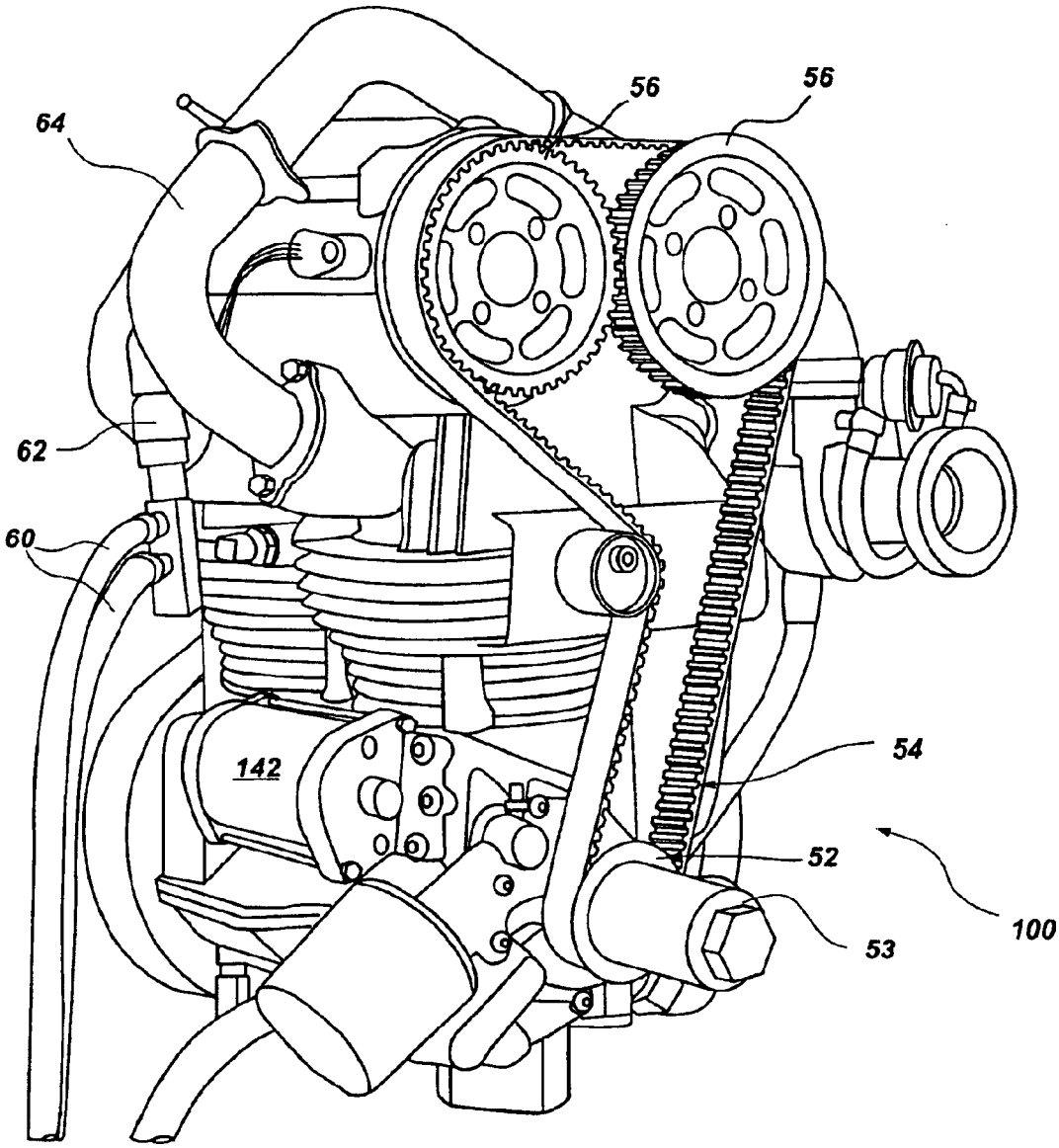
FIG. 2 is a perspective view of a lightweight, four-stroke engine in accordance with an embodiment of the invention.

A lightweight, four-stroke engine in accordance with the present invention is shown generally at 100 in FIG. 2. In this embodiment, a four-stroke engine is provided that includes two pistons disposed side-by side. While the engines illustrated and discussed herein generally include two pistons, it is to be understood that the present invention is not limited to a two-piston engine, but can be utilized with one, two, three, four and more pistons, as dictated by the particular application for which the engine will be used. Each piston is operatively coupled to a crankshaft (50 in FIG. 1), which can be utilized by power take off devices for a number of uses.

In the embodiment shown, a belt drive pulley 52 is operatively coupled to an end of the crankshaft. A drive belt 54 can be disposed around the belt drive pulley and engaged with camshaft gears 56, each of which is attached to an end of a camshaft disposed in cam covers or boxes (24 and 26 in FIG. 1). Thus, rotation of the crankshaft is translated into rotation of the camshafts, which in turn facilitate opening and closing of valves (58 in FIG. 1) which control delivery of combustible material to the cylinders and exhaust of combusted material from the cylinders. Extension 53 can also be provided to enhance the power take off from the crankshaft. In this manner, the end of the crankshaft shown can not only be utilized to power the drive 54, but auxiliary devices can also be coupled to the crankshaft to utilize the power produced by the engine.

Also shown in FIG. 2 are fuel delivery lines 60 which can provide fuel to combustion chambers of the engine. In the embodiment shown, a single fuel injector 62 is provided and controllably delivers fuel for the combustion process. The fuel injector shown is disposed within air delivery tube 64, which delivers air for the combustion process, and is described in further detail below. By providing only a single fuel injector for the combustion process in both cylinders, the fuel delivery system is greatly simplified, and considerable weight is reduced from the overall weight of the engine.

Figure 15:
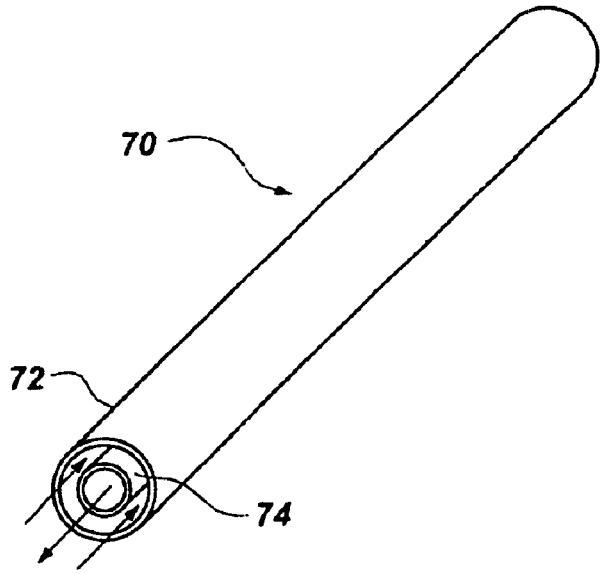

Fuel injectors, known to those skilled in the art, perform optimally when a substantially constant, dynamic stream of fuel is delivered to the injector. In this manner, the fuel which will be delivered next by the injector into the combustion area does not remain stagnant in the injector and is not as susceptible to being preheated by heat existing near the combustion area. Thus, two side-by-side fuel delivery/circulation lines are generally provided in conventional fuel injection systems. In addition to the configuration illustrated in FIG. 2, however, the present invention can incorporate the fuel injector delivery line 70 illustrated in FIG. 15.

In this embodiment, an outer line 72 is provided that is that has a greater flow capacity than is otherwise required by the fuel system of the engine. An inner line 74 can be disposed within the outer line to provide an alternate path for fuel flow than that provided by the outer line. In this embodiment, fuel can be delivered to the injector through the space defined between outer line 72 and inner line 74. Fuel can be returned from the injector through inner line 74.

In this manner, a dynamic, substantially constant flow of fuel can be delivered to the fuel injector with a minimal amount of space being required for fuel delivery lines.

Figure 3:
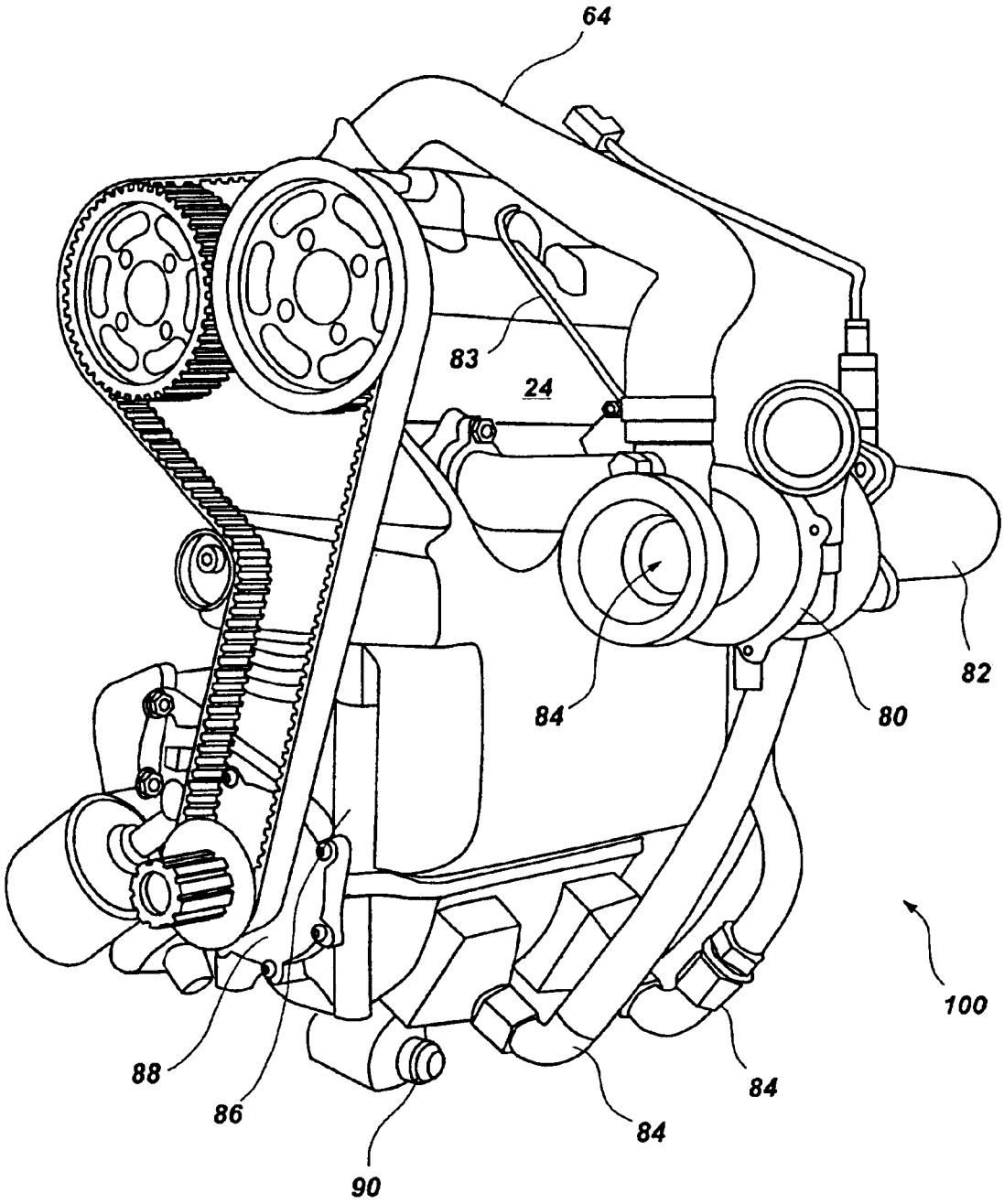
FIG. 3 is another perspective view of the engine of FIG. 2.

FIG. 3 illustrates an alternate view of the engine 100 of FIG. 2. In this view, it can be seen that the air delivery tube 64 is coupled to an air turbocharger 80 that is also coupled to exhaust assembly 82. Turbochargers, as are known in the relevant art, are generally driven by exhaust gasses from an engine and convert the fluid flow energy contained in the exhaust gases into rotational movement. The rotational movement is generally utilized by a compressor component, which compresses and forces clean air delivered through an intake manifold, such as shown at 84. The intake air is thus supercharged to deliver a higher volume of air than otherwise drawn in by conventional methods. Oil feed tube 83 can deliver oil from the cam cover or box 24 to the turbocharger to maintain lubrication of the turbocharger.

In the embodiment shown, feed tubes or hoses 84 can be coupled to a lower portion of crankcase enclosure 86. As discussed in relation to FIG. 1, the feed hoses deliver scavenged air and oil from cam boxes disposed on an upper portion of the engine to the lower crankcase housing. Disposed near an end of the crankshaft is oil pump 88, which can pump oil or lubricant into and through the engine. In one aspect, described in more detail below, the oil pump forces oil upwardly through head studs which include hollow portions for the delivery of oil. Once oil is pumped upwardly through the engine into the cam boxes or covers, the internal air cooling/oil scavenging system can return the oil to an oil reservoir, as discussed in detail above.

Figure 4:
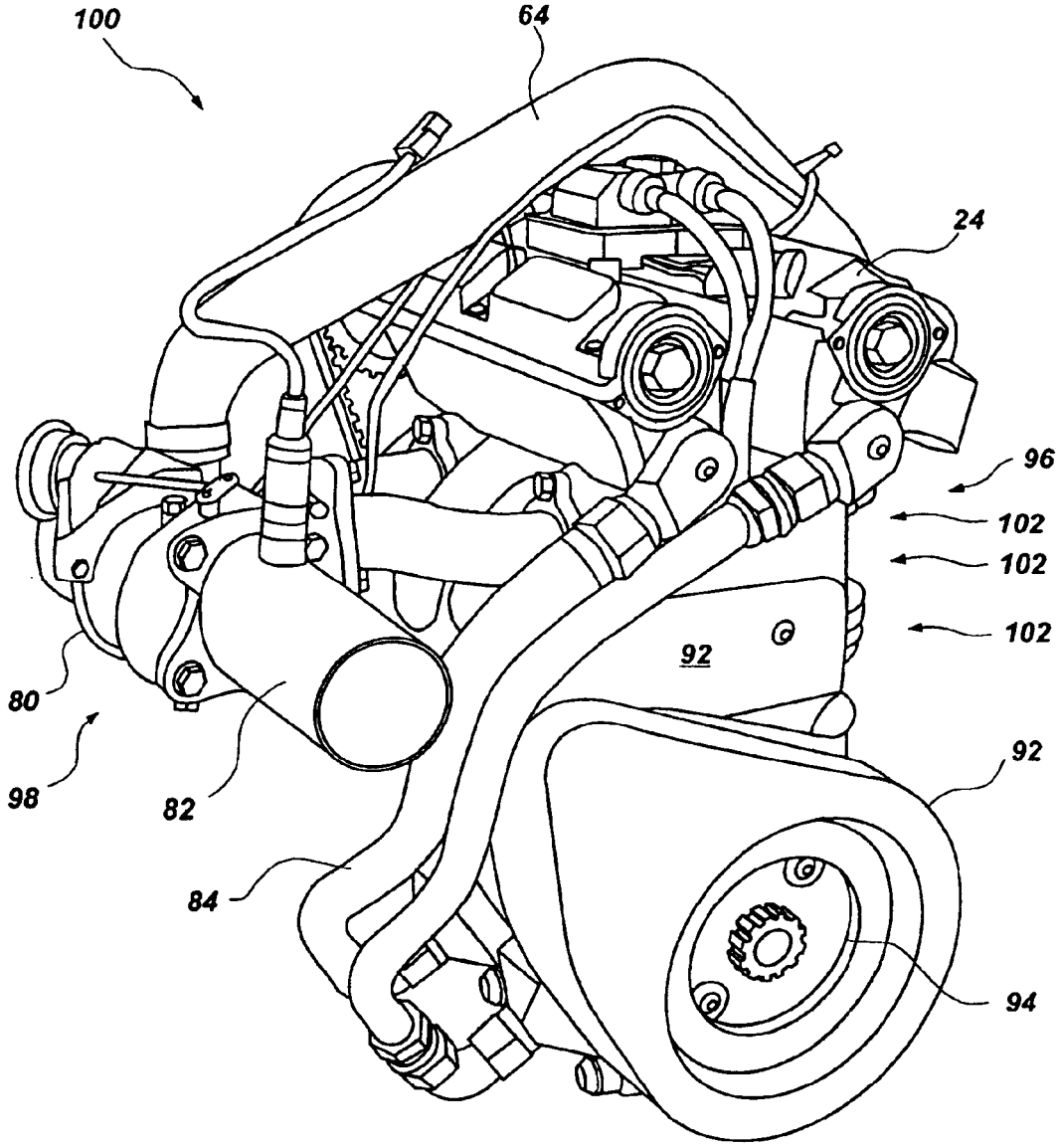
FIG. 4 is another perspective view of the engine of FIG. 2.

It should be noted that the embodiments of the engine illustrated in FIGS. 2 through 5 include a remote oil sump/reservoir that is not illustrated in the drawings. External oil ports 90, shown in FIG. 3, can be used to connect the engine to the remote oil supply. By utilizing a remote oil sump, the engine can be installed in a particular vehicle in an optimal configuration, and the oil sump can be located in the most space-efficient location. Similarly, while a remote oil sump/reservoir can be utilized, in one aspect of the invention, the dry sump reservoir is coupled to an exterior portion of the engine (not shown in the figures). Partly due to the dry sump lubrication system, the engine can be configured to be run in either a vertical or horizontal orientation. The engine shown in FIGS. 2 through 4 is disposed in a vertical orientation, however, with minor modifications to the sump location and other components, the engine will also operate in a horizontal orientation.

Turning to FIG. 4, an external air cooling circulation system is shown and can include a cooling shroud 92 that can be formed to conform to the shape of the engine body. A cooling fan 94 can be associated with the cooling shroud and serves to draw ambient air from one side of the engine to another. In one aspect of the invention the cooling shroud and fan can be configured to draw cool air from an intake side 96 of the engine to an exhaust side 98 of the engine, as shown by airflow arrows 102. The shroud can be formed of a variety of materials, including carbon-fiber composites.

In this manner, a substantially constant external air flow can be maintained around the body of the engine to cool the engine. The shroud can be configured to draw air from around both ends of the engine, as well as through open sections of the engine. In this manner, the engine can be configured into a vehicle, for instance, a rotorcraft, and all intake air (external cooling, internal cooling, combustion intake, etc.) can be drawn in from one side of the engine and all exhaust air (external cooling, internal cooling, combustion exhaust, etc.) can be dispelled from another side of the engine. Thus, the hot exhaust air will not co-mingle with the cool intake air.

The cooling fan 94 can be operatively coupled to the crankshaft (not shown in FIG. 4) in a number of manners. In one aspect of the invention, the cooling fan is directly coupled to the crankshaft and is thereby rotated at a 1:1 ratio with respect to the crankshaft. In another aspect, the cooling fan can be associated with a gearing assembly (not shown) that can increase the rate of rotation of the cooling fan relative to the crankshaft to increase cooling airflow around the engine. In one embodiment, the fan rotates at a ratio of 4:1 with respect to the crankcase, providing an increased rate of airflow across the engine.

While increasing the rate of rotation of the cooling fan 94 can result in increased airflow, the increase in rotation rate can negatively affect the useful life of the fan. The present inventor has discovered that conventional turbocharger compressor fans can be modified to provide superior rotation rates with extended cooling fan life. The compressor fan associated with conventional turbochargers has undergone extensive engineering evolution to provide very rapid rotation rates with extended fan life. This is often accomplished by providing "oil bearings" for the compressor fan which are not as susceptible to failure as conventional bearings. By utilizing a turbocharger fan as a cooling fan for the external cooling system of the present invention, high fan rotation rates can be achieved without sacrificing extended fan life.

In the embodiment illustrated in FIG. 4, feed tubes 84 return air and oil from the cam covers or boxes 24, 26 to the crankcase enclosure. While the engine described in relation to FIG. 1 includes one-way valve 28 which allows ambient air to enter the cam boxes, the embodiment shown in FIG. 4 includes a substantially sealed cam cover or box. As discussed in further detail below, oil can be delivered to the cam boxes through hollow head studs. This oil is then drawn through, or scavenged, from the cam boxes through feed tubes 84. In this manner, the cam covers or boxes in this embodiment are maintained at a negative pressure environment by the negative pressure created in the crankcase housing. This can advantageously reduce the occurrence of oil leaks from the cam covers.

Figure 5:
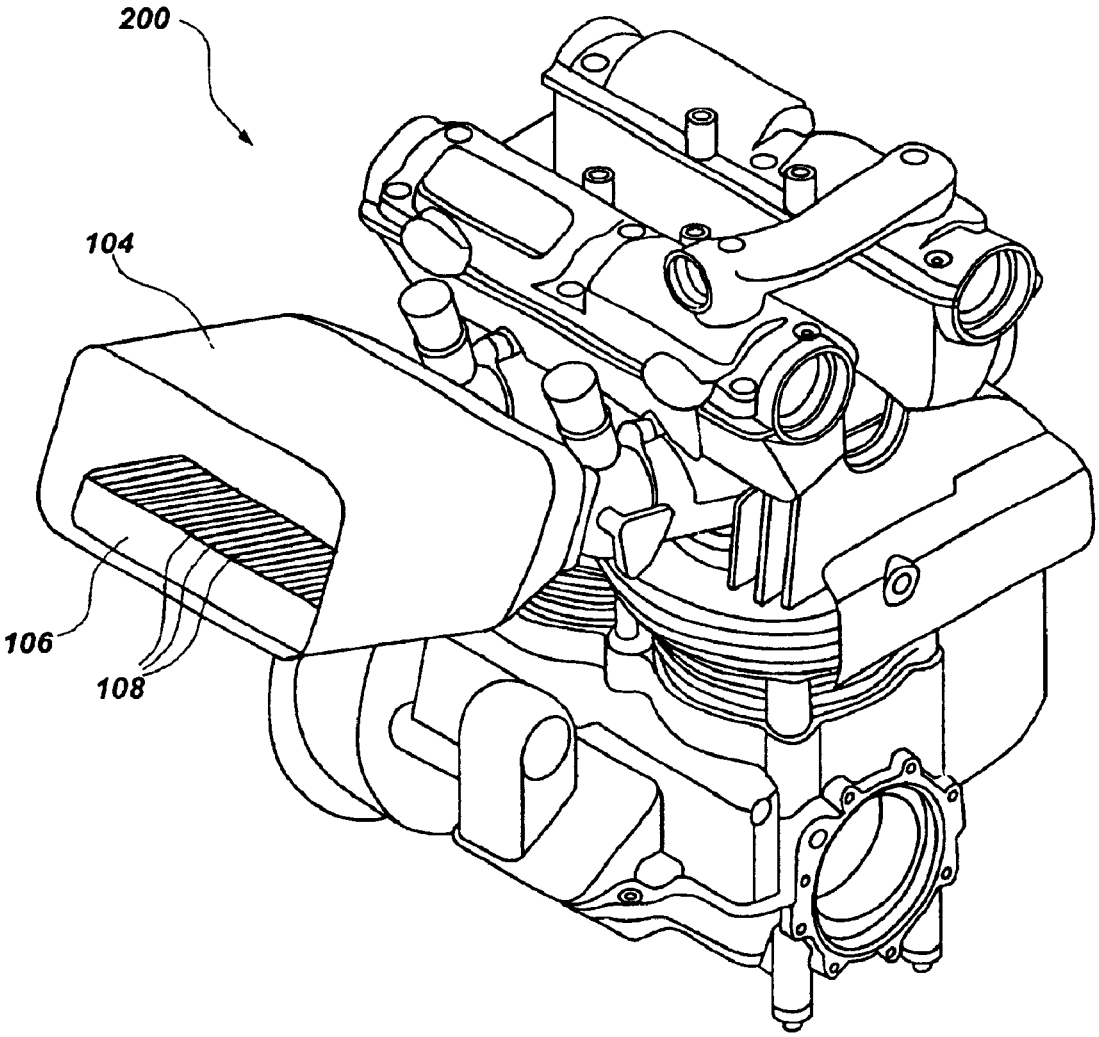
FIG. 5 is a perspective view of another lightweight, four-stroke engine in accordance with an embodiment of the invention.

Turning to FIG. 5, another embodiment of a lightweight, four-stroke engine is shown generally at 200, which employs many of the features and advantages discussed in relation with previous embodiments. In this aspect, an air intake plenum 104 can be used to draw cool air into the engine. Disposed in the plenum can be a compact Engine Management System ("EMS") 108 module which can include substantially all of the components and circuitry required to operate the engine, such as timing and spark control, fuel injector control, charge rectification, etc. The compact EMS can greatly reduce the bulk of the wiring loom, saving considerable weight and space. By including substantially all of the components and circuitry required to operate the engine in a compact EMS, the entire engine can be wired by simply "plugging" a single wire into the EMS.

In this manner, not only is the EMS easily accessible by an operator or repair technician, the EMS is cooled by intake of cool air into the engine. Conventional EMS modules can generate a substantial amount of heat, and, if not properly cooled, can suffer from premature failure from becoming overheated. The present invention advantageously cools the EMS during normal operation of the engine, requiring no additional cooling system for the EMS. Cooling fins 108 can be disposed on an upper surface of the EMS to enhance the cooling capability of the airflow through the plenum.

Figure 6:
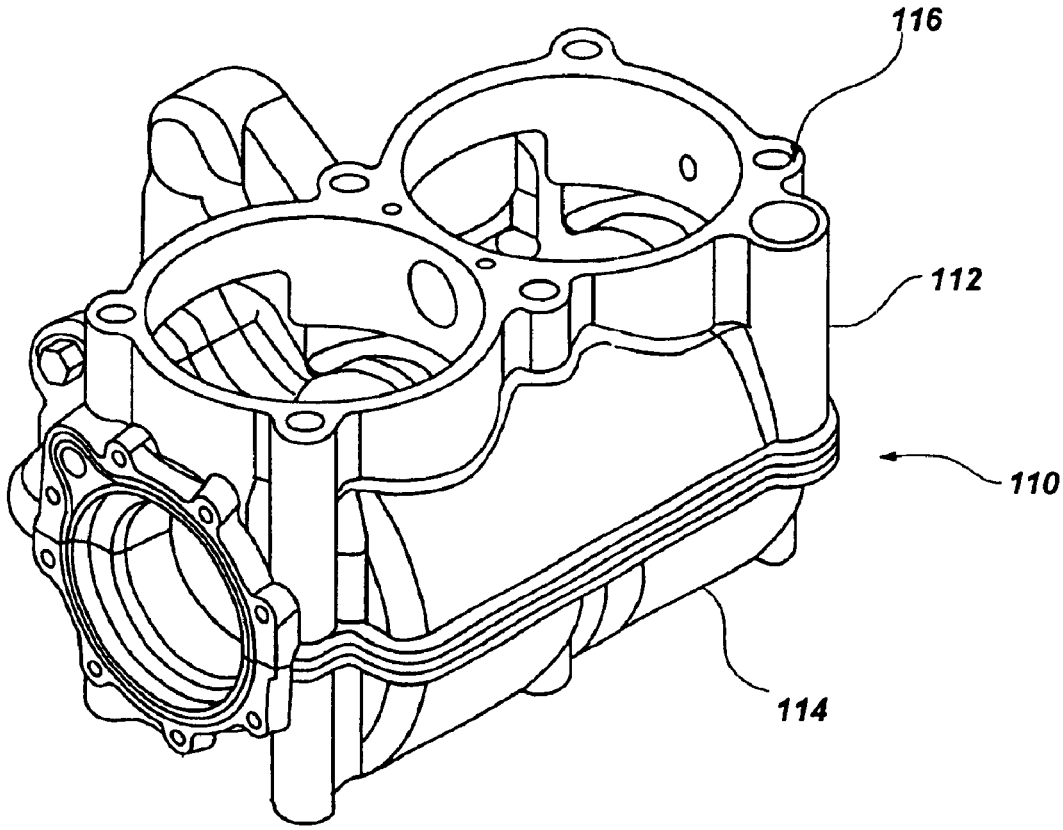
FIG. 6 is a perspective view of a lower and an upper crankcase housing in accordance with an embodiment of the invention.
Figure 8:
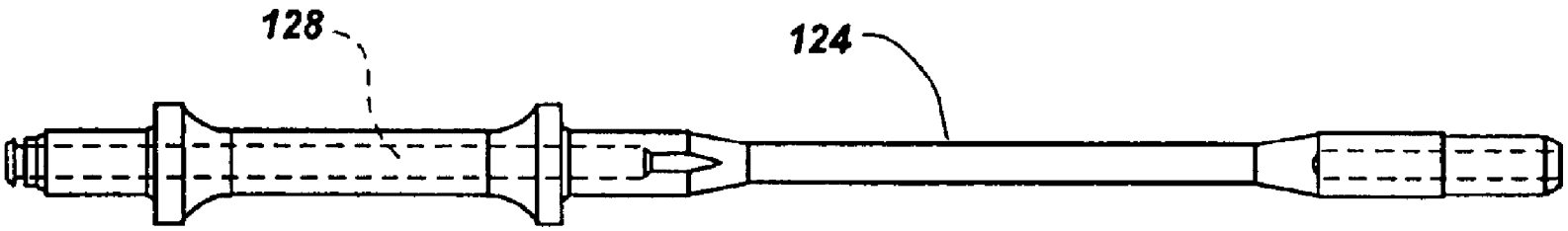
FIG. 8 is a side view of a head stud in accordance with an aspect of the invention.
Figure 9:
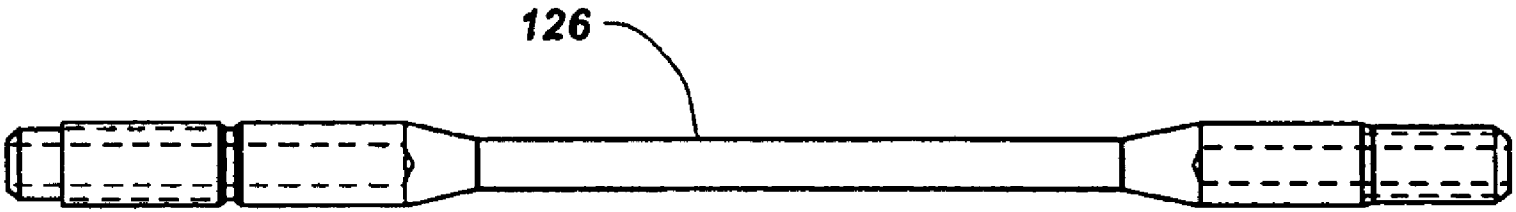
FIG. 9 is a side view of another head stud in accordance with an aspect of the invention.

The lightweight, four-stroke engine of the present invention can be formed using only a minimum of required parts, thus reducing the required weight of the engine. As illustrated in FIG. 6, the crankcase housing 110 can include a lower portion 114 and an upper portion 112. Shown combined in FIG. 4, the crankcase housing can include channels 116 for receiving securing means to secure the portions together. The channels can allow the external engine components to be secured together by a minimum of parts. Head studs, such as those shown at 124 and 126 in FIGS. 8 and 9, can be used to attach the crankcase housing to the cylinder head assembly (120 in FIG. 7).

Figure 7:
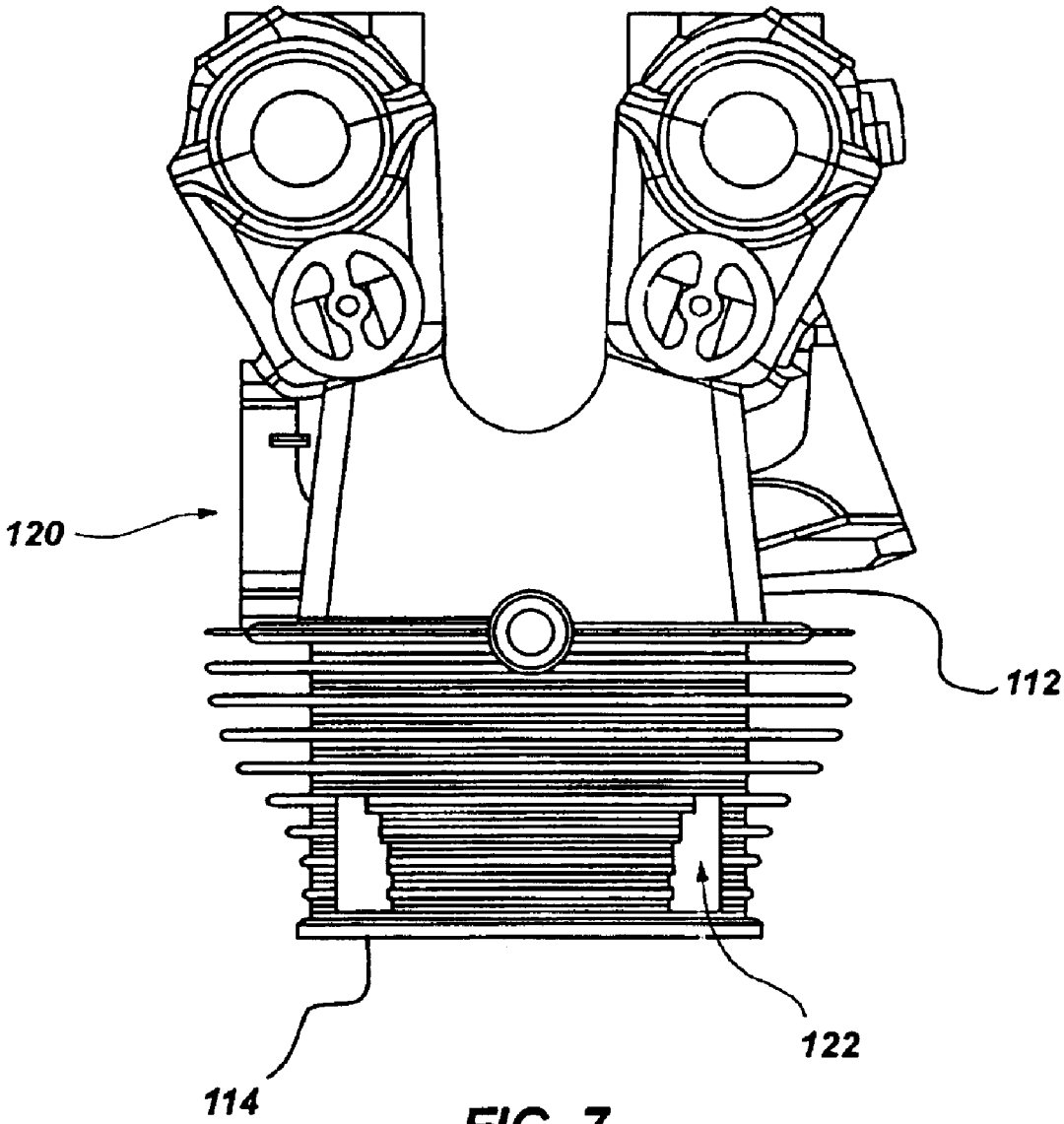
FIG. 7 is a side view of a cylinder terminal housing in accordance with an aspect of the invention.

Thus, the engine body can be formed of only three major components, a lower crankcase housing 114, an upper crankcase housing 112, and a cylinder head or terminal housing 120. By reducing the number of major components of the engine, an overall weight of the engine can be reduced, as well as simplifying the construction of the engine to facilitate easy disassembly and assembly of the engine. As shown in FIG. 7, receiving ports 122 can be included in the cylinder head assembly, in which head bolts (124 and 126 in FIGS. 8 and 9) can be threaded or otherwise attached. The head studs or bolts can then pass through the lower 114 and upper 112 crankcase housing components and the entire assembly can be secured together.

The head studs 124, 126 engage the cylinder head assembly 120 in a lower portion of the head assembly, near the location that the head assembly mates with the upper crankcase housing 112. In this manner, the entire head is not held under tension, but rather is fixed in place on top of the crankcase by the head studs or bolts. Also, the head bolts 124 can include at least one hollow section 128 through which oil can be forced. Thus, once the cylinder head assembly is coupled to the upper crankcase housing 112, it is not necessary to provide internal or external conduits for the flow of oil to the cam boxes 24, 26, as the head studs holding the engine components together can convey oil to and from the various components. Thus, an additional weight savings is provided by the dual-purpose head studs or bolts.

The cylinder head assembly 120 can be formed in a substantially symmetrical configuration to allow the head assembly to attached to the crankcase housing 110 in alternate orientations. In this manner, the exhaust and intake sides of the engine can be reversed to tailor the engine to specific applications. Advantageously included in the cylinder head assembly are the piston cylinders, in which the piston reciprocate, and conventional piston "head" structure to receive valves, valve springs, etc. Conventional four-stroke engines generally include separate block and head units which must be fastened together, generally under tight torque tolerances. By combining the two components, the present invention provides an engine with lighter weight and simpler design. The combustion chamber and/or bore within the cylinder head assembly can be coated with ceramic or some similar material to reduce heat loss and improve surface contact between the piston and cylinder wall.

In addition, each of the major engine components can be sealed to each other by a substantially continuous sealing structure, such as an O-ring or similar seal. Thus, no gaskets or sealants are required to assemble the engine components, providing an engine that can be maintained or repaired by an operator without specialized equipment or training.

Figure 10:
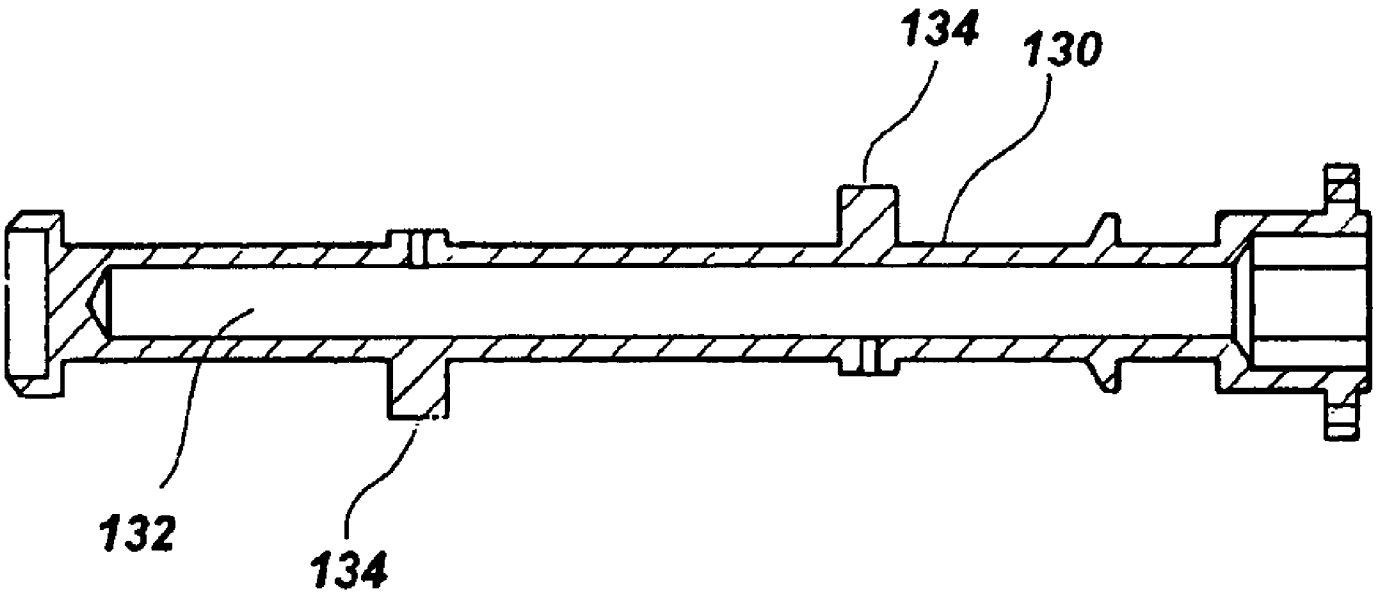
FIG. 10 is a cut-away side view of a camshaft in accordance with an aspect of the invention.

Shown in FIG. 10 is a representative camshaft 130 that can be utilized in the lightweight engine. The camshaft can include one or more hollow sections 132 that can serve to reduce the weight of the camshaft and thereby reduce the overall weight of the engine. Cams 134 on the camshaft can interface with a valve assembly (not shown) to open and close intake and exhaust valves, as is known in the art.

Figure 11:
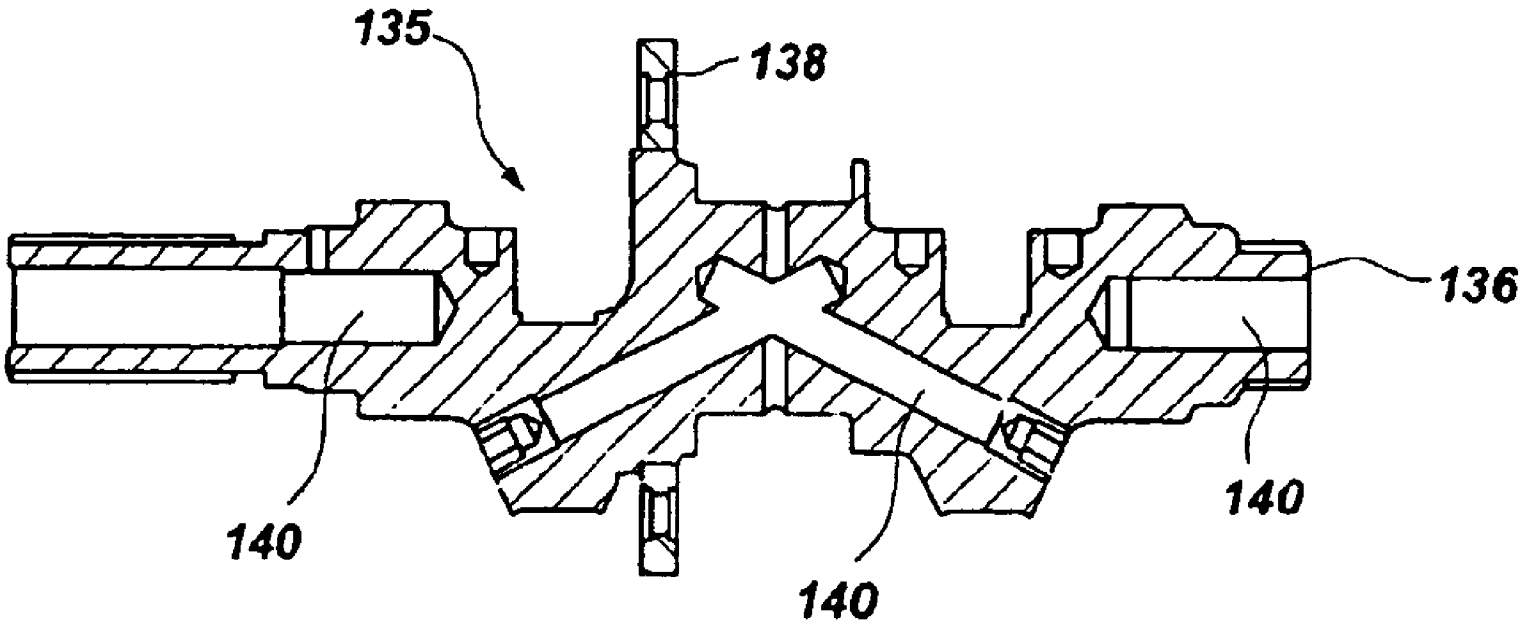
FIG. 11 is a cut-away side view of a crankshaft in accordance with an aspect of the invention.

A crankshaft assembly 135 in accordance with an aspect of the invention is shown in FIG. 11. The crankshaft assembly can include a crankshaft 136 which can have one or more hollow sections 140 formed therein to reduce the weight of the camshaft. The present inventor has found that the crankshaft, during normal operation, incurs stresses present in one or more concentrations of the crankshaft. By forming the hollow sections in the crankshaft in areas in which stresses in the crankshaft are minimal, the weight of the crankshaft can be reduced without compromising the strength of the crankshaft. The crankshaft can be balanced and can be improved by the use of light alloys such as titanium.

A ring gear 138 can be formed as part of the crankshaft assembly 135. The ring gear can be disposed intermediate ends of the crankshaft 136 and can serve as a rotational counter weight. The ring gear can be engageable by a starter motor (142 in FIG. 2) which can be energized to start the engine. The starter motor can be a reversible starter motor, that is, the polarity of the starter motor can be reversed so that, when energized, the starter motor turns the crankshaft in an alternate rotational direction. This feature can be enhanced by including reversible camshafts in the engine. In this manner, each the of the camshafts can be reversed 180°, and the starter motor can be reversed 180°, to provide an engine that will operate in an opposite rotational direction.

Figure 12:
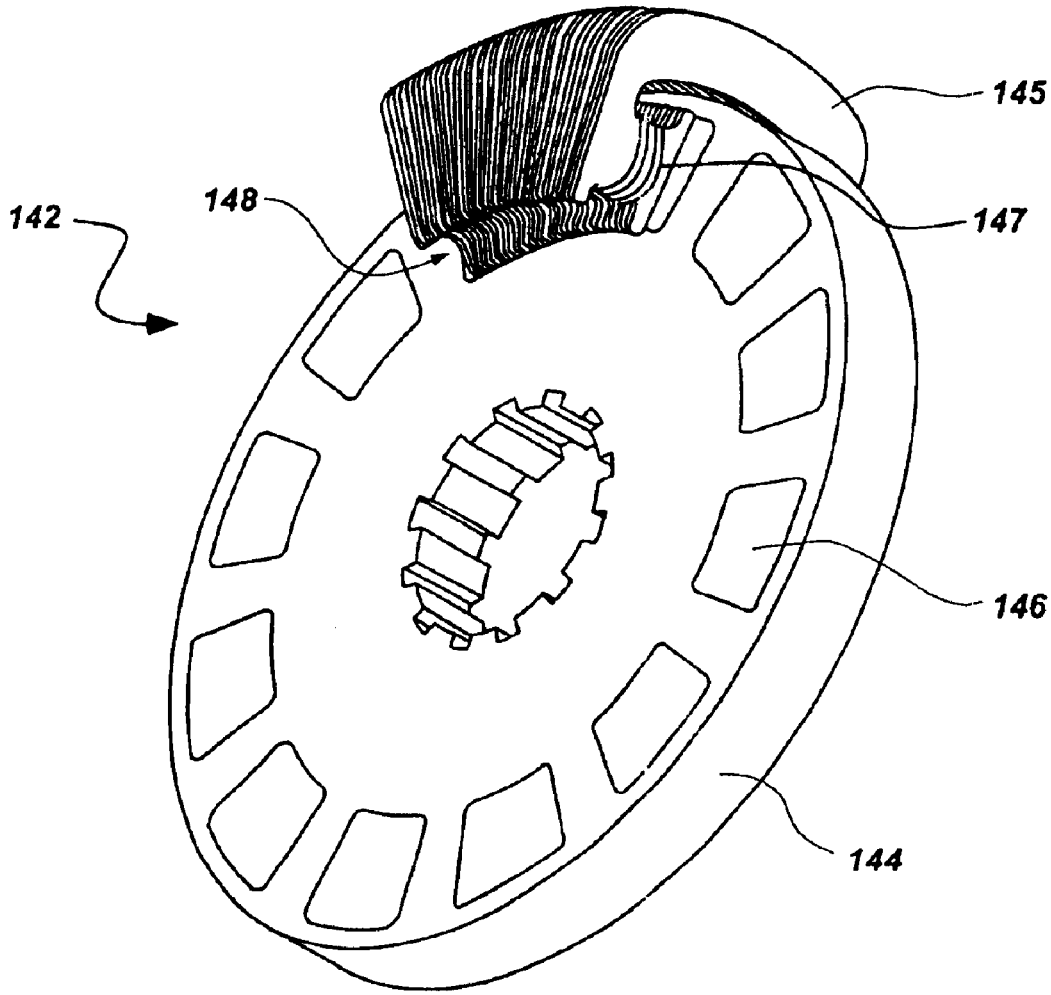
FIG. 12 is a perspective view of an alternator disk rotor in accordance with an aspect of the invention.
Figure 13:
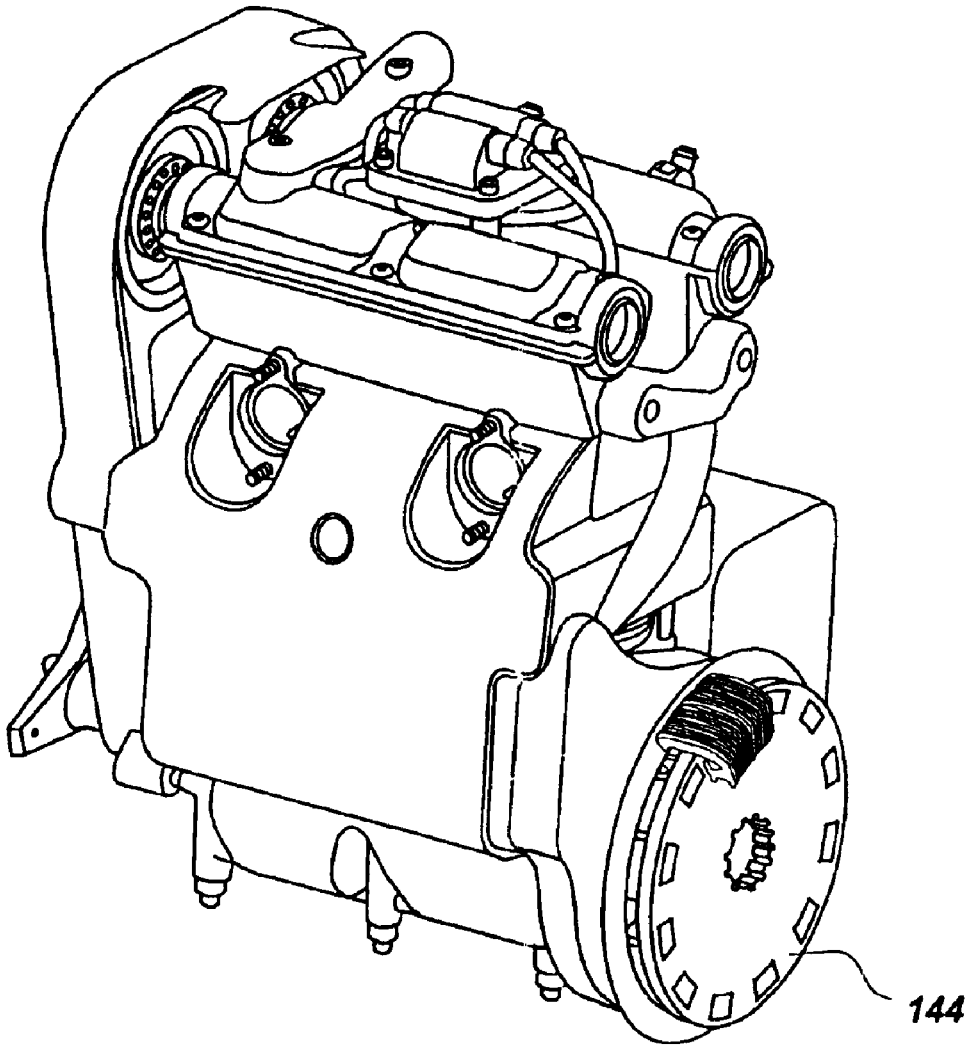
FIG. 13 is a perspective view of a lightweight, four-stroke engine in accordance with an aspect of the invention.

The lightweight engine can include an alternator to power various electrical components of the engine. The engine illustrated in FIGS. 2 through 4 includes a conventional alternator (not shown, as disposed within the crankcase). In one aspect of the invention, illustrated in FIG. 12, the alternator includes a rotor disk 144 and a stator 145. The rotor disk can be coupled to the crankshaft, as illustrated in FIG. 13. The rotor disk can include one or more conventional air vanes (not shown) that produce airflow when the rotor disk rotates. In this manner, the alternator shown in FIG. 13 produces electrical energy for various components of the engine while at the same time producing airflow for cooling of the engine.

The rotor disk 144 can include a series of magnet segments 146 disposed around a periphery of the disk. The magnet segments can be fitted into "windows" in the disk and can be exposed on both sides of the disk to provide a magnetic field usable by the stator on both sides of the disk. The stator 145 can be formed a stationary caliper; that is, the fingers of the calipers do not move relative to each other. The caliper stator can be disposed over and around a perimeter of the rotor disk.

The caliper stator 145 can be made of thin iron slivers, much like in a conventional alternator, but arranged like the caliper on a disk brake. The alternately colored bands indicate an iron/insulator "sandwich." Windings 147 can be disposed around the iron slivers in notch 148 and can run parallel to the rotation of the disk. The caliper stator system can utilize both sides of the magnets' magnetic fields. In contrast, a conventional alternator uses the field on one side of the magnet only. In this manner, the engine alternator can achieve about twice the normal output of that having coils on one side of the disk only.

Figure 14:
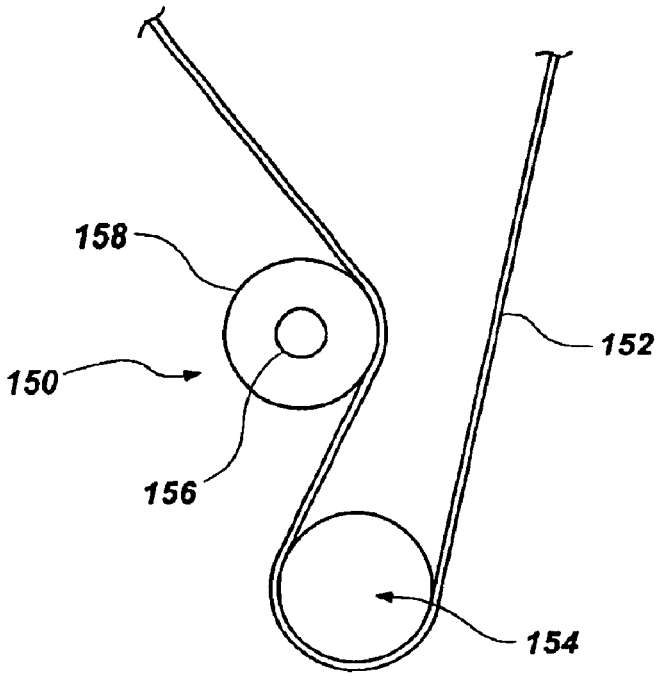
FIG. 14 is a front, partially sectioned view of a drive belt and alternator in accordance with an aspect of the invention; and FIG, 15 is a perspective, partially sectioned view of a fuel delivery tube in accordance with an aspect of the invention.

An alternate alternator configuration is illustrated in FIG. 14. In this embodiment, an alternator 150 can be disposed in the train of drive belt 152 which can be driven at 154 by the crankshaft (not shown in this view). The alternator can be disposed in a location generally used by a conventional belt tensioner and can include an inner stator 156 rotatably attached to an outer rotor 158. As the belt is driven by the crankshaft, the belt will in turn rotate the outer body of the alternator, which will result in the alternator creating electrical power for use by various electrical components of the engine. In this manner, the alternator not only generates electric power, but replaces conventional belt tensioners and thereby effectuates a reduction in overall weight of the engine. The inner alternator body can include adjustable coupling means which allow it to be coupled to the engine body, and also positioned to adjust the tension in the belt.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A lightweight, four stroke engine, comprising:

a crankcase enclosure;

at least one piston assembly disposed within the crankcase enclosure, the piston assembly cooperating with the crankcase enclosure to provide an internal pressure to the crankcase enclosure which varies between a positive and a negative pressure;

an air intake assembly operatively coupled to a first section of the engine and the crankcase enclosure, the air intake assembly including at least one air conduit configured to provide non-combustive air flow from the first section of the engine to the crankcase enclosure of the engine; and at least one valve disposed within the air intake system, the valve being configured to restrict air flow from the crankcase enclosure when positively pressurized and to allow airflow into the crankcase enclosure when negatively pressurized.

2. The engine of claim 1, wherein the first section of the engine is a cam cover enclosure of the engine, and wherein the air intake assembly circulates air from the cam cover enclosure to the crankcase enclosure.

3. The engine of claim 1, further comprising a dry sump lubricant distribution system operatively coupled to the air intake system, the dry sump lubricant distribution system and the air intake system cooperating to scavenge lubricant from the engine, the dry sump lubricant distribution system configured to enable operation of the engine in a vertical, horizontal or intermediate configuration.

4. The engine of claim 1, further comprising a second air conduit operatively coupled to the crankcase enclosure and the combustion chamber of the engine, the second air conduit providing pressurized air from the positively pressurized crankcase enclosure to the combustion chamber to increase an overall pressure of a combustible mixture provided to the combustion chamber of the engine.

* * * * *